US005291938A

United States Patent [19]

Metevelis et al.

[11] Patent Number: 5,291,938

[45] Date of Patent: Mar. 8, 1994

[54] VERTICALLY PARTED MOULD HAVING A FEEDER UNIT THEREIN

[75] Inventors: D. George Metevelis, Strongsville, Ohio; Barry C. Wingfield, Tamworth, England

[73] Assignee: Foseco International Limited, Birmingham, England

[21] Appl. No.: 890,225

[22] Filed: May 29, 1992

[30] Foreign Application Priority Data

Jun. 18, 1991 [GB] United Kingdom ..... 9113121

[51] Int. Cl.[5] ..... B22C 9/02

[52] U.S. Cl. ..... 164/359; 164/360

[58] Field of Search ..... 164/349, 350, 351, 359, 164/360, 364, 365; 249/119, 110

[56] References Cited

U.S. PATENT DOCUMENTS

| | | | |
|---|---|---|---|
| 3,815,665 | 6/1974 | Baur | 164/359 |
| 4,423,762 | 1/1984 | Trinkl et al. | 164/37 |
| 4,467,858 | 8/1984 | Trinkl et al. | 164/360 |
| 4,694,884 | 9/1987 | Butler et al. | 164/360 |
| 4,779,669 | 10/1988 | Corbett et al. | 164/360 |
| 4,858,673 | 8/1989 | Campana et al. | 164/359 |

FOREIGN PATENT DOCUMENTS

| | | | |
|---|---|---|---|
| 0202741 | 9/1988 | European Pat. Off. | B22C 9/08 |
| 1089126 | 9/1960 | Fed. Rep. of Germany . | |
| 2121353 | 9/1972 | Fed. Rep. of Germany . | |
| 2928166 | 1/1981 | Fed. Rep. of Germany | 164/360 |
| 4420726 | 5/1969 | Japan | 164/360 |
| 2096504 | 10/1982 | United Kingdom | 164/360 |
| 2141649 | 1/1985 | United Kingdom | 164/359 |

OTHER PUBLICATIONS

Foseco brochure "Foundry Practice", No. 218, Dec. 1989, article entitled "DYKAL-A New Concept in Feeding Aluminum Gravity Castings."

*Primary Examiner*—Paula A. Bradley
*Assistant Examiner*—James Miner
*Attorney, Agent, or Firm*—Nixon & Vanderhye

[57] ABSTRACT

A mould for metal casting which is vertically parted into two parts, comprises one or more mould cavities and a plurality of feeder cavities each communicating with a mould cavity, and has a feeder unit comprising a plurality of interconnected feeder sleeves therein, each of the feeder sleeves surrounding one of the feeder cavities. The mould may be a vertically parted permanent mould or die, or particularly a vertically parted sand mould.

18 Claims, 2 Drawing Sheets

VERTICALLY PARTED MOULD HAVING A FEEDER UNIT THEREIN

Figure 1:
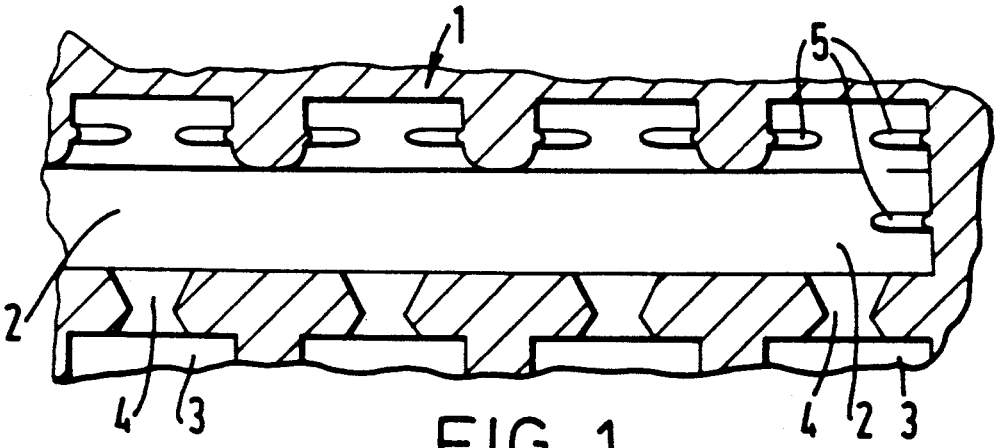

This invention relates to vertically parted moulds having feeder units comprising a plurality of interconnected feeder sleeves therein.

When molten metal is cast into a mould and allowed to solidify the metal shrinks during solidification. In order to compensate for this shrinkage and to ensure that a sound casting is produced it is usually necessary to employ so-called feeders located above and/or at the side of the casting. When the casting solidifies and shrinks molten metal is fed from the feeder(s) into the casting and prevents the formation of shrinkage cavities. In order to improve the feeding effect and to enable the feeder volume to be reduced to a minimum it is common practice to surround the feeder cavity and hence the feeder itself with an exothermic and/or heat-insulating material which retains the feeder metal in the molten state for as long as possible, and which is generally used in the form of a sleeve.

Vertically parted sand moulds are commonly produced using an automated, rapid production method on a moulding machine such as a DISAMATIC machine. (DISAMATIC is a trade mark). In such a method the mould is produced in two halves, one half of which is termed the core placement side or in the case of DISAMATIC machine produced moulds, the ram side. Cores and, if they are to be used, filters and feeder sleeves are either manually set or automatically set into the mould using a piece of equipment called a core setter which then automatically incorporates them in the ram placement side of the mould. As the cycle time of the machine is very fast the time available for setting cores etc into the core setter is very limited, usually of the order of 8-15 seconds. This time is often insufficient to place feeder sleeves so that in many cases feeder sleeves cannot be used in vertically parted moulds. In such cases feeding of the castings is achieved by utilizing relatively large feeders which are surrounded by the moulding sand. However the use of such sand feeders can cause problems due to insufficient yield, and since the feeders are close together interaction between the feeding effect of adjacent feeders can occur and have a detrimental effect on the castings, for example graphite flotation in iron castings or carbon segregation in steel castings, and a variable metallographic structure in both. With such sand lined feeders it may also be necessary to have a large neck joining the feeder to the casting. In other cases there may be sufficient time to place only one feeder sleeve in the core setter due to the constraints of the mould production cycle.

It has now been found that the problems associated with sand lined feeders and the difficulty of incorporating feeder sleeves can be overcome by the use of a feeder unit comprising a plurality of interconnected feeder sleeves.

According to the invention there is provided a mould parted vertically into two parts the mould comprising one or more mould cavities and a plurality of feeder cavities each communicating with a mould cavity and the mould having therein a feeder unit comprising a plurality of interconnected feeder sleeves, each of the feeder sleeves surrounding one of the feeder cavities.

The mould may be any type of vertically parted mould, including vertically parted permanent moulds or dies, but the invention is particularly applicable to vertically parted sand moulds, such as a H-Process moulds or vertically parted shell sand moulds, or more particularly moulds produced on a DISAMATIC machine.

The shape of the individual feeder sleeves forming the unit may take a number of forms.

For example the perimeter of the inner and outer surfaces of the feeder sleeve may be circular, oval, square or rectangular, and the wall thickness may or may not be uniform from the top to the bottom of the sleeve. The outer surface and/or the inner surface of the feeder sleeve may be vertical, tapered from the bottom of the sleeve to the top or tapered from the top of the sleeve to the bottom. Alternatively the sleeve may be spherical in shape.

The feeder sleeves may be open at their top end or they may be so-called blind feeder sleeves which are closed at their top end by a cover, which may be for example flat or hemi-spherical, and which may be formed integrally with the sleeve or fixed to the sleeve. The cover may have a Williams core formed integrally with or fixed to the underside of the cover in order to ensure that during solidification of the casting atmospheric pressure is exerted on the feeder metal so as to improve the feeding effect.

The individual sleeves may also have a plurality of ribs on their inner surface as described in European Patent No. 0202741, or the inner and/or the outer-surface of the sleeves may be fluted.

The size of the individual feeder sleeves will vary depending on the feeding requirements of the casting or castings being produced in the mould, but will be chosen to as to ensure optimum feeding or maximum yield for minimum possible internal sleeve volume. When a number of the same casting are being produced in the same mould, for example in the production of crankshaft castings, each of the sleeves will be of the same size. When a single casting requiring a number of feeders, or a number of different castings are being produced in a mould the feeder unit may contain feeder sleeves of different shapes or sizes.

The connection between the individual feeder sleeves may be simply a joint between the outer surfaces of adjacent sleeves. Preferably, the connecting portions of the feeder unit are offset from the parting line of the mould. Alternatively, each of the feeder sleeves may be connected to a separate part of the feeder unit, which may be for example a rod or bar shaped structure and which may or may not be formed from the same material as the sleeves themselves. The sleeves may be connected directly to the rod or bar, or they may be connected via an intermediate connecting piece of material. In the latter case, providing the rod or bar is itself essentially a linear structure, the sleeves themselves may be located at different distances from the rod or bar. The rod or bar may have an aperture which forms part of the runner of the mould, or if desired the rod or bar may be hollow and the channel passing through it may form part of the runner of the mould.

The feeder unit is preferably formed from exothermic material, heat-insulating material or exothermic and heat-insulating material. Alternatively, the feeder sleeves may be formed from such materials and the connecting portions of the unit may be formed from a material such as bonded sand.

In the production of a sand mould according to the invention it is preferable that the pattern forming the cavity on the core placement side of the mould produces a number of horizontal ribs or "crusher strips" in the sand surrounding the cavity, so that when the feeder unit is inserted it is held firmly in place by the ribs or crusher strips. The cavity of the other part of the mould is preferably made slightly oversize compared with the external dimensions of the feeder unit so that when the two parts of the mould close together correct location of the unit is ensured, and no crushing between the feeder unit and the sand of the mould occurs.

The mould of the invention offers a number of advantages.

In normal practice in the production of vertically parted sand moulds the cavity, into which a feeder sleeve is inserted in the core placement side of the mould, has a volume which is in excess of 50% of the volume of the feeder sleeve, usually 55% or 60% of the volume of the feeder sleeve. This is done to prevent the sleeve from falling out of the cavity, and to prevent the sleeve from tilting and crushing the other half of the mould when the two halves of the mould are brought together. As a result the axis of the feeder sleeve is offset from the parting line of the mould and this can sometimes lead to problems due to inadequate feeding of the casting. Using a feeder unit of interconnected feeder sleeves and in particular, a unit in which the connecting portions of the feeder unit are offset from the parting line of the mould, or in which the feeder sleeves are connected by a separate part of the unit such as a bar or rod, it is not necessary to offset the feeder sleeves from the parting line because the connecting part of the unit and exactly half the volume of each of the sleeves can be inserted in the core placement side of the mould. As the proportion of the mass of the unit which is inserted is greater than 50% of the total there is no danger that the unit will fall out or tilt.

The feeder unit allows a number of sleeves to be set in the mould within a few seconds thus conforming to the constraints of the mould production cycle on machines such as DISAMATIC machines, without increasing costs or capital costs on machinery.

Each of the feeders sleeves forming the unit can have a breaker core formed integrally with the sleeve or fixed to the sleeve at its bottom end. Additional time for incorporating the breaker core at the core setting stage is therefore not needed, and the benefits of breaker cores in terms of removing feeders from castings can be utilized. If desired the breaker core may be used as a means of holding a filter if the mould is a top-poured mould.

Figure 2:
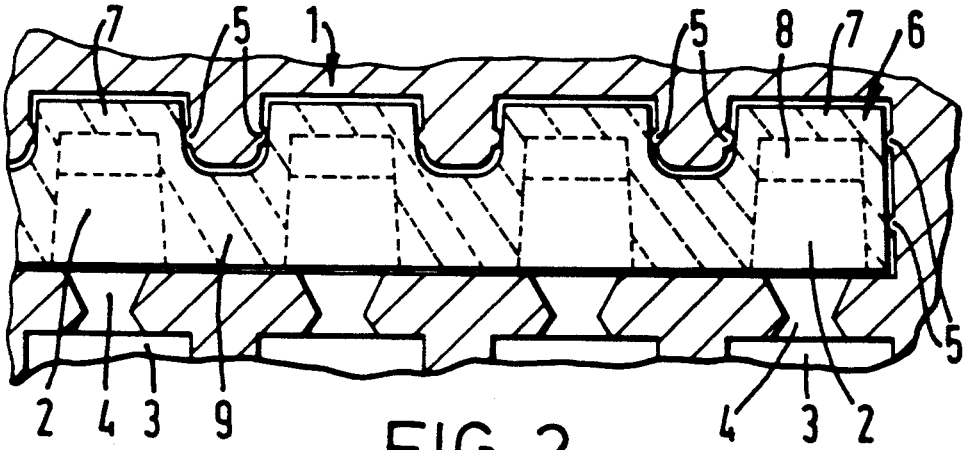
Figure 3:
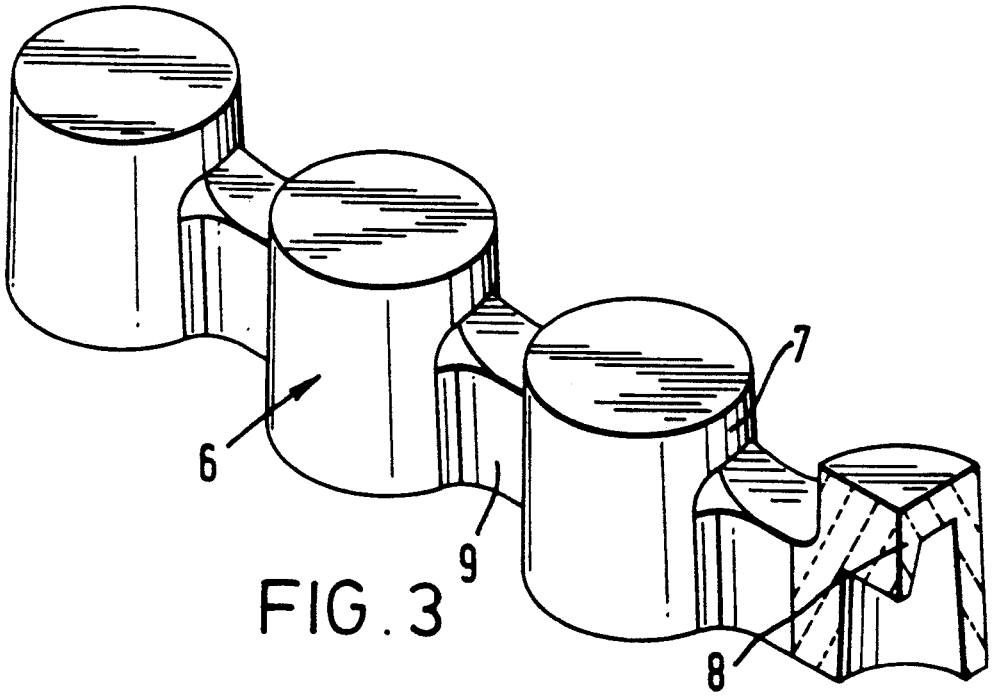
Figure 4:
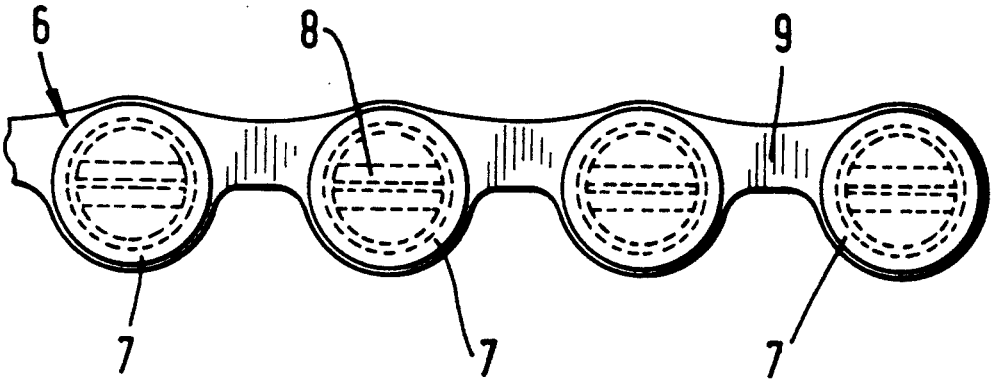
Figure 5:
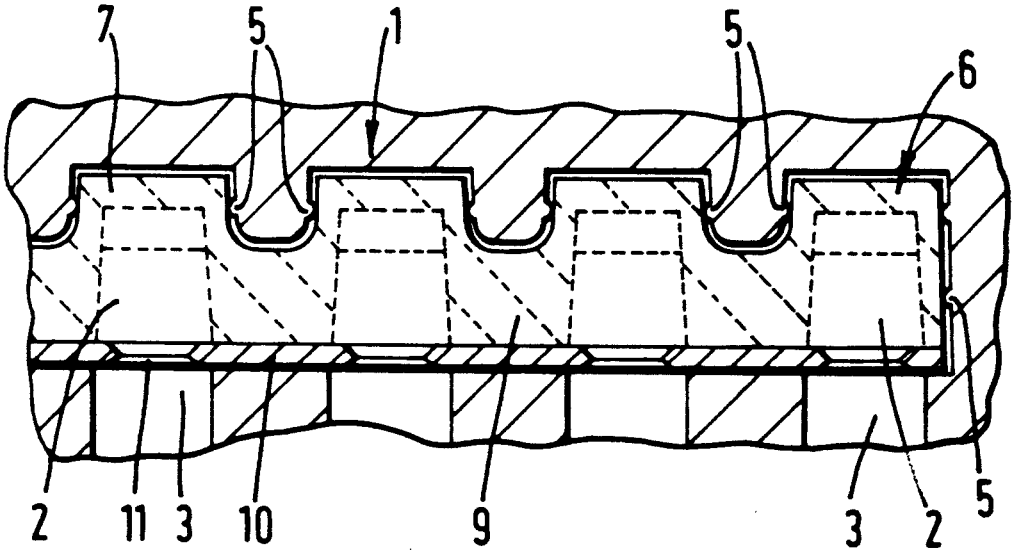

The invention is illustrated with reference to the accompanying drawings in which:

FIG. 1 is a vertical section through the parting line of a vertically parted sand mould having a plurality of feeder cavities FIG. 2 is the same view as FIG. 1 showing the part mould containing a feeder unit comprising a plurality of interconnected feeder sleeves FIG. 3 is a perspective view of the feeder unit shown in FIG. 2 with parts of the sleeve at one end cut away FIG. 4 is a top plan view of the feeder unit shown in FIG. 2, and FIG. 5 is a similar view to FIG. 2 but showing a feeder unit having a breaker core fixed to its base.

Referring to the drawings, a vertically parted sand mould 1 has a plurality of feeder cavities 2 each communicating with a mould cavity 3 via a neck 4. The sand of the mould 1 surrounding the feeder cavities 2 has horizontal ribs or crushing strips 5. A feeder unit 6 made of exothermic material and comprising a plurality of feeder sleeves 7, each having a Williams core 8, and joined together by connecting portions 9 is inserted in the mould 1 so that each of the feeder sleeves 7 surrounds one of the feeder cavities 2 and is held firmly in place by the ribs or crusher strips 5. The connecting portions 9 are offset from the parting line of the mould so that the proportion of the total mass of the feeder unit which is inserted in the core placement side of the mould 1 is greater than 50% of the total mass and the feeder unit 6 cannot fall out or tilt.

In FIG. 5 the feeder unit 6 has a breaker core 10 fixed to its base and the breaker core 10 has an aperture 11 located centrally at the bottom of each of the feeder cavities 2 and feeder sleeves 7 connecting the feeder cavities 2 directly with the mould cavity 3.

We claim:

1. An integral preformed mould parted vertically into only two parts the mould comprising one or more mould cavities and a plurality of feeder cavities each communicating with a mould cavity and the mould having therein a feeder unit comprising a plurality of interconnected feeder sleeves, each of the feeder sleeves having an inner surface and an outer surface and each of the feeder sleeves surrounding one of the feeder cavities.

2. A mould according to claim 1 wherein the inner and outer surfaces have a perimeter which is circular, oval, square or rectangular.

3. A mould according to claim 1 wherein at least one of the outer and inner surfaces is vertical.

4. A mould according to claim 1 wherein at least one of the outer and the inner surfaces of the feeder sleeves tapers from the bottom of the sleeve to the top.

5. A mould according to claim 1 wherein at least one of the outer and the inner surfaces of the feeder sleeves tapers from the top of the sleeve to the bottom.

6. A mould according to claim 1 wherein the feeder sleeves are closed at their top end by a cover.

7. A mould according to claim 6 wherein the cover is flat.

8. A mould according to claim 6 wherein the cover is hemi-spherical.

9. A mould according to claim 6 wherein the feeder sleeves have a Williams core formed integrally with or fixed to the cover.

10. A mould according to claim 1 wherein at least one of the inner and outer surfaces of the feeder sleeves is fluted.

11. A mould according to claim 1 wherein each of the feeder sleeves has a breaker core formed integrally with or fixed to the sleeve at its bottom end.

12. A mould according to claim 1 wherein the feeder sleeves are spherical in shape.

13. A mould according to claim 1 wherein the feeder sleeves are interconnected by joints between the outer surfaces of adjacent sleeves.

14. A mould according to claim 1 wherein the feeder unit has connecting portions which are offset from the parting line of the mould.

15. A mould according to claim 1 wherein each of the feeder sleeves is connected to a separate part of the feeder unit.

16. A mould according to claim 15 wherein the separate part is a rod shaped or bar shaped structure.

17. A mould according to claim 1 wherein the mould is a sand mould, and the feeder unit is inserted in a cavity in one part of the mould having horizontal ribs in the sand surrounding the cavity.

18. A mould according to claim 17 wherein the other part of the mould has a cavity which is slightly oversize compared with the external dimensions of the feeder unit.

* * * * *